US009297607B2

(12) United States Patent
Dvorak

(10) Patent No.: US 9,297,607 B2
(45) Date of Patent: Mar. 29, 2016

(54) CONVERSION OF A FIREARM TO A FIREARM SIMULATOR

(71) Applicant: Vojtech Dvorak, Tulsa, OK (US)

(72) Inventor: Vojtech Dvorak, Tulsa, OK (US)

( * ) Notice: Subject to any disclaimer, the term of this patent is extended or adjusted under 35 U.S.C. 154(b) by 0 days.

(21) Appl. No.: 14/480,635

(22) Filed: Sep. 9, 2014

(65) Prior Publication Data

US 2015/0226516 A1 Aug. 13, 2015

Related U.S. Application Data

(60) Provisional application No. 61/939,273, filed on Feb. 13, 2014.

(51) Int. Cl.

| | |
|---|---|
| ***F41B 11/62*** | (2013.01) |
| ***F41A 33/02*** | (2006.01) |
| ***F41A 33/06*** | (2006.01) |
| ***F41B 11/50*** | (2013.01) |
| ***F41B 11/723*** | (2013.01) |

(52) U.S. Cl.

CPC ..... *F41B 11/62* (2013.01); *F41A 33/02* (2013.01); *F41A 33/06* (2013.01); *F41B 11/50* (2013.01); *F41B 11/723* (2013.01)

(58) Field of Classification Search

CPC ..... F41B 11/50; F41B 11/62; F41B 11/723; F41A 33/02; F41A 33/06

USPC ..... 124/70, 71, 73, 75, 76, 77

See application file for complete search history.

(56) References Cited

U.S. PATENT DOCUMENTS

| | | | | |
|---|---|---|---|---|
| 2,110,509 | A * | 3/1938 | Von Latscher-Latka et al. | 124/58 |
| 2,605,756 | A * | 8/1952 | Bertschinger | 124/58 |
| 3,938,262 | A * | 2/1976 | Dye | F41G 3/2655 42/116 |
| 3,951,038 | A * | 4/1976 | Van Langenhoven | 89/7 |
| 4,195,422 | A * | 4/1980 | Budmiger | F41A 33/02 434/20 |
| 4,352,665 | A * | 10/1982 | Kimble | F41A 33/02 434/22 |
| 4,370,822 | A * | 2/1983 | Rabino | 42/106 |
| 4,380,437 | A * | 4/1983 | Yarborough, Jr. | F41G 3/2655 42/106 |
| 4,480,999 | A * | 11/1984 | Witherell | F41A 33/06 434/18 |
| 5,716,216 | A * | 2/1998 | O'Loughlin | F41J 5/02 273/365 |
| 5,947,738 | A * | 9/1999 | Muehle | F41A 33/02 124/57 |
| 6,146,141 | A * | 11/2000 | Schumann | F41A 33/06 434/11 |
| 6,572,375 | B2 * | 6/2003 | Shechter et al. | 434/19 |
| 6,682,350 | B2 * | 1/2004 | Kehl et al. | 434/18 |
| 6,869,285 | B1 * | 3/2005 | Jones, II | G09B 19/00 42/10 |
| 7,621,747 | B1 * | 11/2009 | Burrow | F41A 33/02 434/19 |
| 8,602,784 | B2 * | 12/2013 | Dvorak | 434/18 |

(Continued)

FOREIGN PATENT DOCUMENTS

DE 103 49 194 A1 4/2005

*Primary Examiner* — Bret Hayes

(74) *Attorney, Agent, or Firm* — James R Bell

(57) ABSTRACT

Apparatus for conversion of a firearm into a compressed gas powered firearm simulator for simulating shooting including a simulated barrel unit, which includes a rechargeable compressed gas reservoir therein. The reservoir in the barrel unit is rechargeable via a fill port included in the barrel unit, and a metering valve provided in the barrel unit permits the pulsed release of compressed gas from the barrel unit to simulate firing.

23 Claims, 9 Drawing Sheets

(56) References Cited

U.S. PATENT DOCUMENTS

| | | | | |
|---|---|---|---|---|
| 9,146,069 | B2 * | 9/2015 | Monti | F41A 33/06 |
| 2005/0074726 | A1 * | 4/2005 | Metcalfe et al. | 434/18 |
| 2005/0191601 | A1 * | 9/2005 | Dvorak | 434/16 |
| 2005/0260545 | A1 * | 11/2005 | Schavone | 434/18 |
| 2006/0027225 | A1 * | 2/2006 | Homsky | F41B 11/62 124/72 |
| 2011/0281243 | A1 * | 11/2011 | Uhr | F41A 33/00 434/16 |
| 2013/0008421 | A1 * | 1/2013 | Lee | 124/71 |
| 2014/0026878 | A1 * | 1/2014 | Jones | 124/75 |

* cited by examiner

CONVERSION OF A FIREARM TO A FIREARM SIMULATOR

CROSS-REFERENCE TO RELATED APPLICATIONS

This application is related to and claims priority to U.S. Provisional Application No. 61/939,273 filed Feb. 13, 2014, which is incorporated herein by reference in its entirety.

BACKGROUND

This disclosure relates generally to converting an actual firearm to a firearm simulator and more particularly to either a long gun or a handgun weapon simulator.

Firearms have been converted into firearm simulators by replacement of parts of the firearm with simulator parts for simulated shooting such that the resultant firearm comprises a combination of actual firearm components and simulated firearm components. The simulated firearm components have included a simulated barrel unit and a simulated magazine unit. The prior simulated magazine units have included a compressed gas container or a connection to an external compressed gas source. The compressed gas is used to provide energy to operate the weapon simulator by actuating valve means in the simulated barrel unit. The compressed gas is conducted from the compressed gas container, or the external compressed gas source to the simulated barrel unit.

When actuated, the valve means forces movement of a slide and compression of a recoil spring and subsequent venting. The resulting recoil simulates the feel of actual weapon firing. A laser beam pulse means is responsive to the simulated weapon firing whereby the laser beam pulse means emits a laser beam onto a target. It would be advantageous to improve simulated weapon firing by reducing the number of parts resulting in a reduction of cost, and also a less complex weapon simulator.

SUMMARY

Apparatus for conversion of a firearm into a compressed gas powered firearm simulator for simulating shooting including a simulated barrel unit which includes a rechargeable compressed gas reservoir therein. The reservoir in the barrel unit is rechargeable via valve means included in the barrel unit, and further valve means provided in the barrel unit permits the pulsed release of compressed gas from the barrel unit to simulate firing.

DETAILED DESCRIPTION

Figure 1:
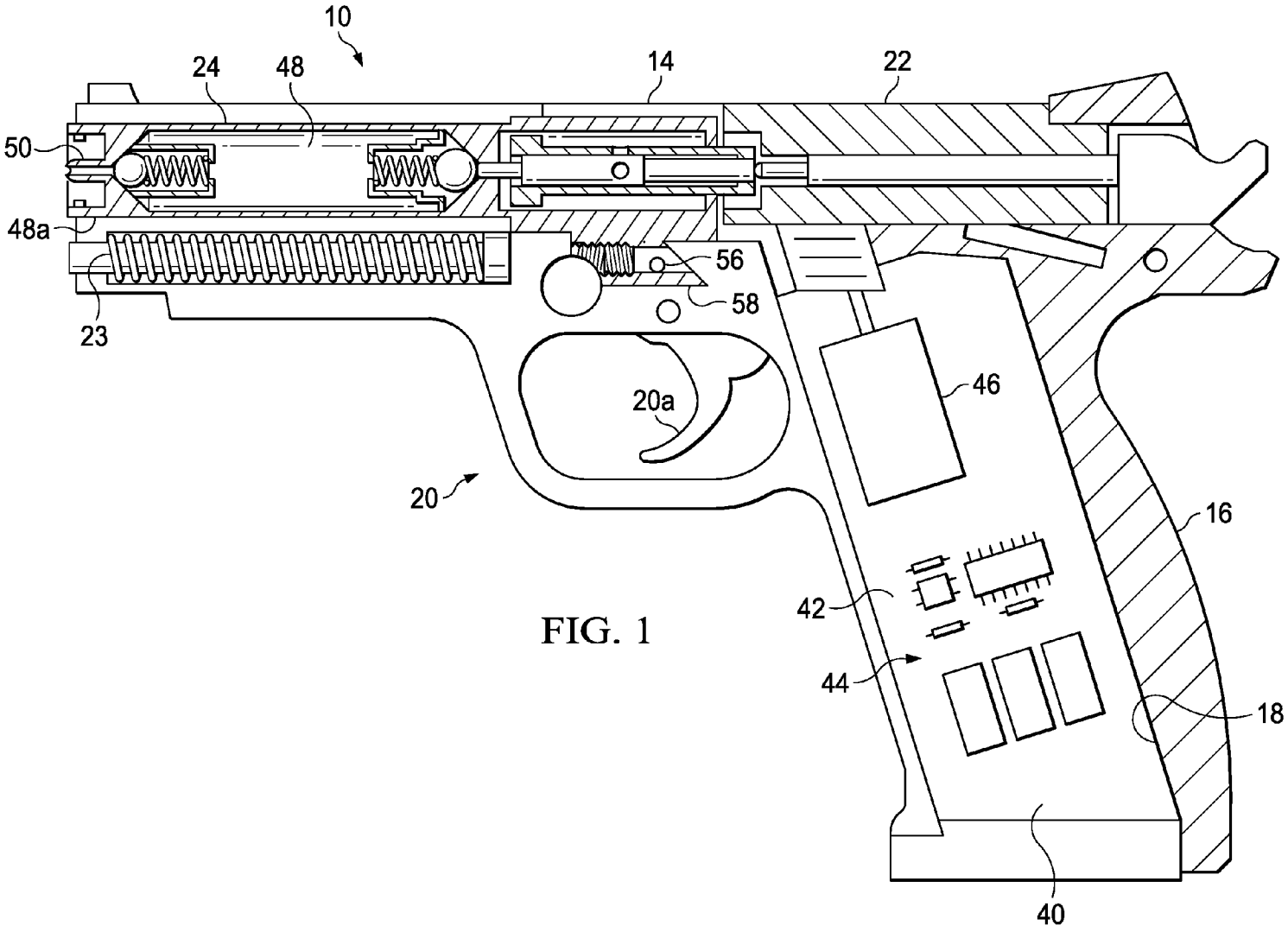
FIG. 1 is a cut-away side view illustrating an embodiment of a handgun configured for simulated firing.

Apparatus is provided for non-permanent conversion of a firearm into a compressed gas powered firearm simulator for simulated shooting. The firearm includes a combination of actual firearm components and simulated firearm components. The firearm may be a handgun 10, FIG. 1 or may be a long gun 12, FIG. 2. The handgun 10, includes a frame 14 having a grip portion 16, a magazine portion 18, a trigger portion 20, a slide portion 22 and a recoil spring 23. A firearm barrel portion (not shown) is replaced by a simulated barrel unit 24. The long gun 12, FIG. 2, includes a frame 26 having a stock portion 28, a magazine portion 30 and a trigger portion 32. A firearm barrel portion (not shown) is replaced by a simulated barrel unit 34, a simulated bolt 36 and recoil spring 38. As used herein, the term long gun may include a rifle or shotgun of the repeating, single shot, semiautomatic or automatic type.

Figure 2:
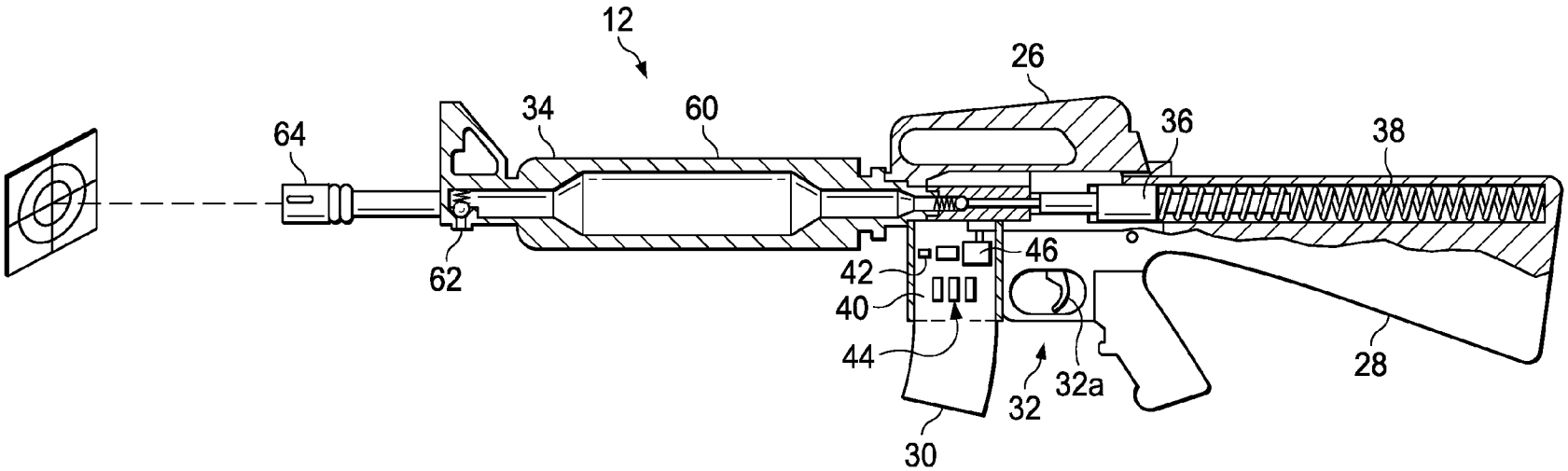
FIG. 2 is a cut-away side view illustrating an embodiment of a long gun configured for simulated firing.

Additional features of the pistol 10, FIG. 1, and rifle 12, FIG. 2 include a simulated magazine unit 40 which may include a shot counter 42, a receiver 44 for receiving a remote signal to simulate a jam in the firearm, and an actuator 46 to interrupt simulated firing in response to a predetermined number of simulated shots being fired.

Figure 3:
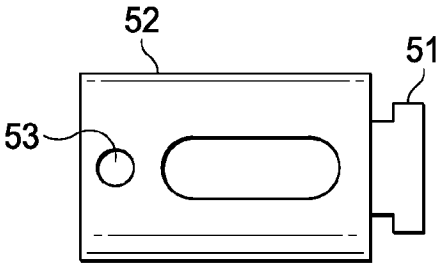
FIG. 3 is a side view illustrating an embodiment of a laser unit used with a simulated firearm.

The simulated barrel unit 24, FIG. 1, includes a reservoir or chamber 48 for sealingly storing a compressed gas such as $CO_2$. One end 48*a* of cylinder 48 is threaded and includes a fill port 50 which may be of the male or female type and a check valve. Also, the end 48*a* may be a twist-lock, a quick-lock or a bayonet type of latching mechanism as an alternative to being threaded. The threaded end 48*a* can threadably receive a laser unit 52, FIG. 3. The laser unit 52 is sight adjustable via an adjustment screw 53, and is threadably removable 51 from end 48*a* to provide access to fill port 50. In addition, reservoir 48 may be attached to a larger capacity auxiliary reservoir 54, FIG. 4, to increase the available number of simulated shots. Referring again to FIG. 1, an adjustment screw 56 and pin 58 arrangement is provided adjacent the trigger portion 20 to take up play due to production tolerances in various handgun makes and models when simulated barrel unit 24 is installed in frame 14. It is shown herein that the term fill port can be located in line with a barrel end or may be a side fill port on the side of a barrel.

Figure 4:
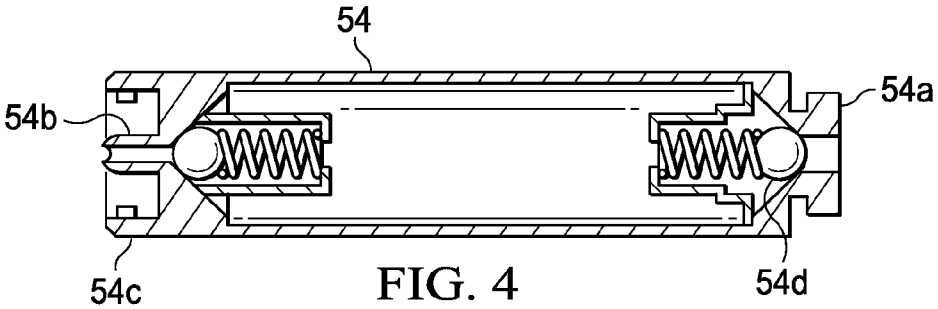
FIGS. 4 and 6*a* are cut-away side views illustrating an embodiment of an external compressed gas reservoir attached to a barrel unit of a simulated firearm.

The reservoir 48, FIG. 1, is size enhanced by attachment of the supplemental, and larger capacity, auxiliary reservoir 54, FIG. 4, to increase the available number of simulated shots. The auxiliary reservoir 54 includes a threaded first end 54*a* and a fill port 54*b* at a threaded second end 54*c*. Thus, removal of laser unit 52 from end 48*a* of reservoir 48 permits the auxiliary reservoir first end 54*a* to be threaded onto the threaded end 48*a* of reservoir 48 such that the fill port 50 engages and unseats a ball 54*d* resiliently seated at the first end 54*a* of reservoir 54. This provides open fluid communication between the reservoirs 48 and 54. Laser unit 52 is then threaded into the second end 54*c*. In this manner, the auxiliary reservoir 54 is added to enhance the simulated firing capacity of handgun 10.

Figure 6:
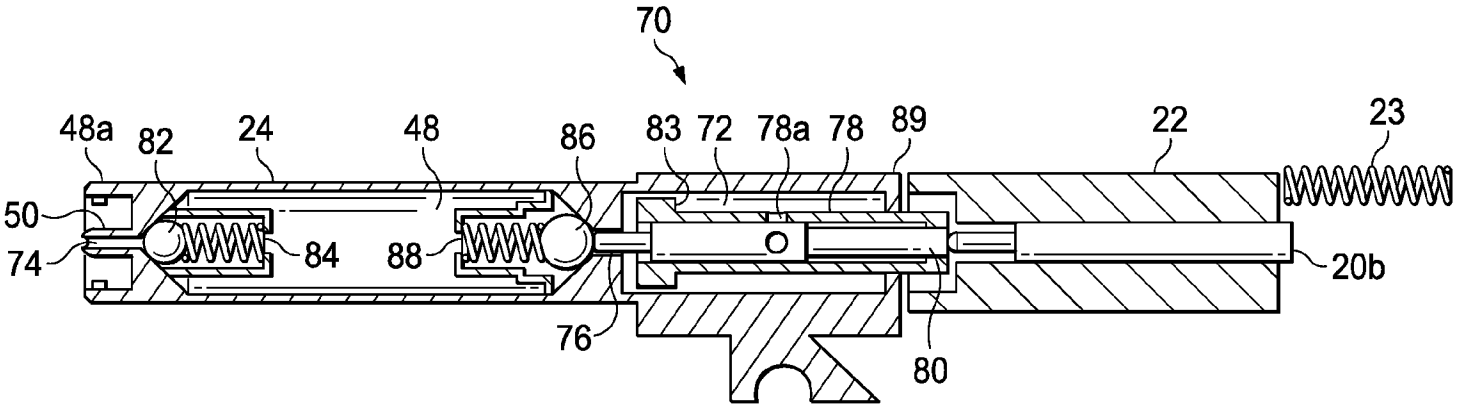
FIGS. 6-6*f* and 7 are cut-away side views illustrating embodiments of simulated barrel units for use in converting actual firearms into simulated handguns and long guns, respectively.

Referring to FIGS. 1 and 6, the simulated firing of handgun 10 is further discussed below. The simulated barrel unit 24 includes a housing 70 which contains a chamber 72 and the reservoir 48. Fill port 50 is positioned at threaded end 48*a* of housing 70 and the chamber 72 is at an opposite end of housing 70. Reservoir 48 includes an inlet 74 in fill port 50 at end 48*a* and an outlet 76 fluidly connecting reservoir 48 with chamber 72. A piston 78 includes a striker 80 movably retained in the piston 78. A fill port 50 is provided with a one-way check valve, which may be a ball valve 82, or other shaped valve member, which is resiliently urged by optional spring 84 to seat and seal inlet 74, and a second or metering valve 86 is provided which may also be a ball or other suitable shape, which is resiliently urged by spring 88 to seat and seal outlet 76. Actuation of a trigger 20*a* in trigger portion 20 urges a firing pin 20*b* into engagement with striker 80, which is moved sufficiently to unseat valve 86 and admit the compressed gas from reservoir 48 into chamber 72. As a result, slide portion 22 and piston 78 are urged rearwardly along with striker 80. Shoulder 83 of piston 78 stops further rearward movement of piston 78 due to engagement with a shoulder 89 of chamber 72. The slide 22 continues in further rearward motion until venting occurs followed by forward motion of the slide 22 due to a recoil spring 23. During the recoil cycle, FIG. 6*a* when piston 78 stops moving aft, striker 80 telescopes out of the piston 78 and moves the slide 22 rearward, thus harnessing energy of the compressed gas to do useful work. When striker 80 passes across exhaust vent 78*a*, pressure escapes with an audible puff. In several applications shown herein, metering is achieved by predetermined stiffness of a spring (or other resilient member) and predetermined movement of the valve tappet (ball or other shape). A valve housing sets compression of the valve spring and limits movement of the valve tappet. This determines the time duration of the valve to stay open, which meters the amount of gas injected into an associated recoil chamber, e.g. 72, 90, 122, see FIGS. 6, 7 and 8, which produces the desired amount of recoil.

Figure 6A:
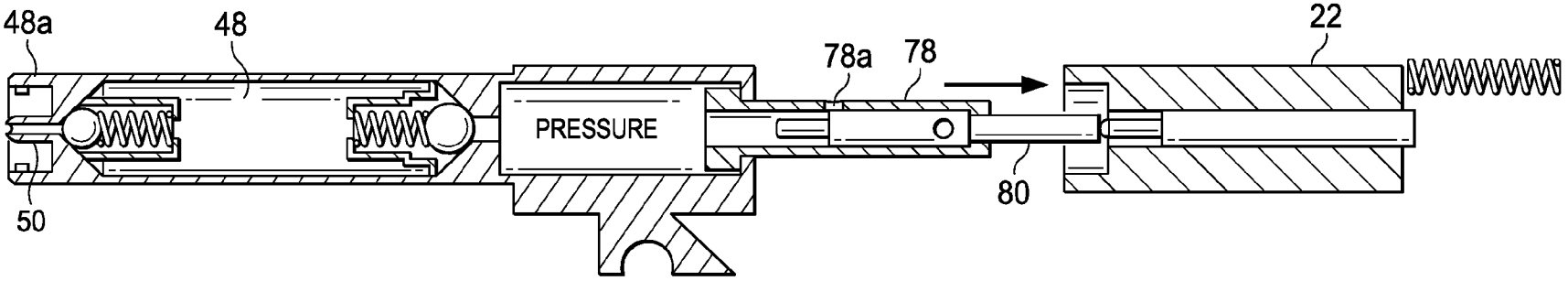
Figure 6B:
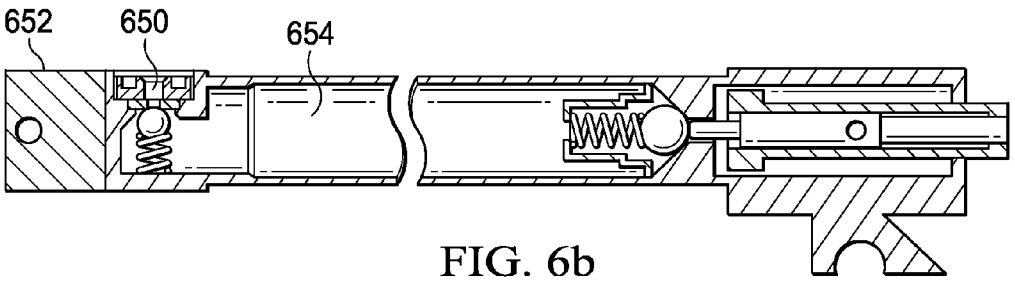

As an alternative, an auxiliary reservoir 654, FIG. 6*b* may include a side fill port 650 instead of fill port 50 as illustrated in FIGS. 1 and 6*a*. Thus, a laser unit 652, FIG. 6*b*, may be suitably connected to an end of reservoir 654 adjacent the side fill port 650.

Figure 6C:
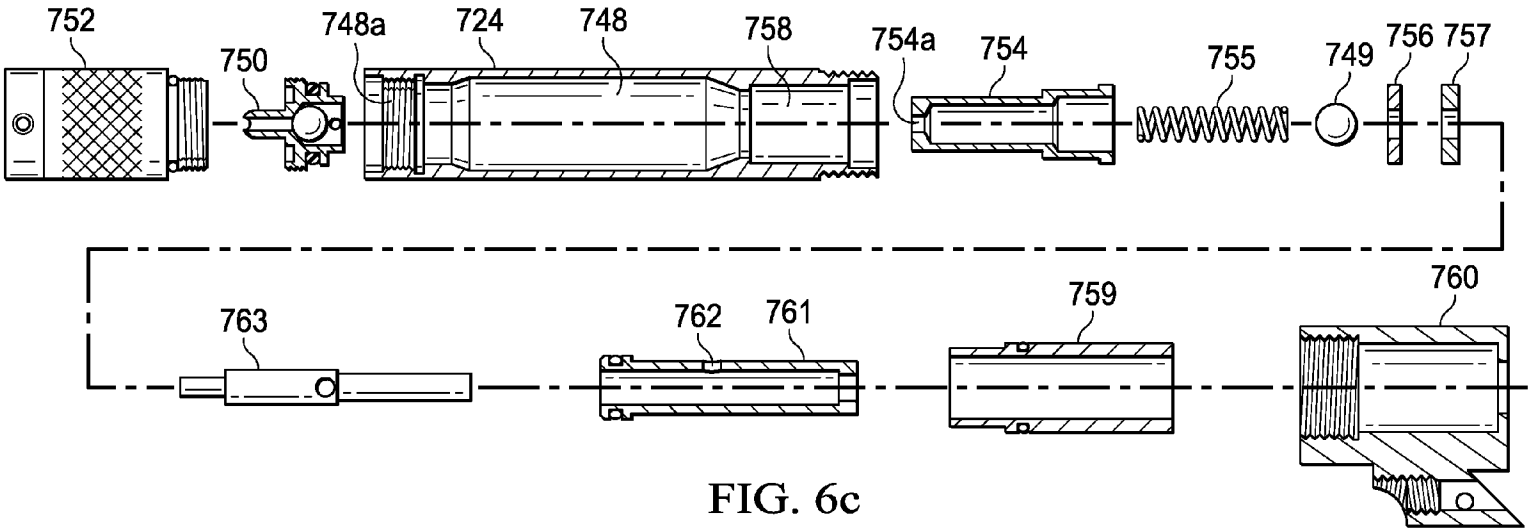
Figure 6D:
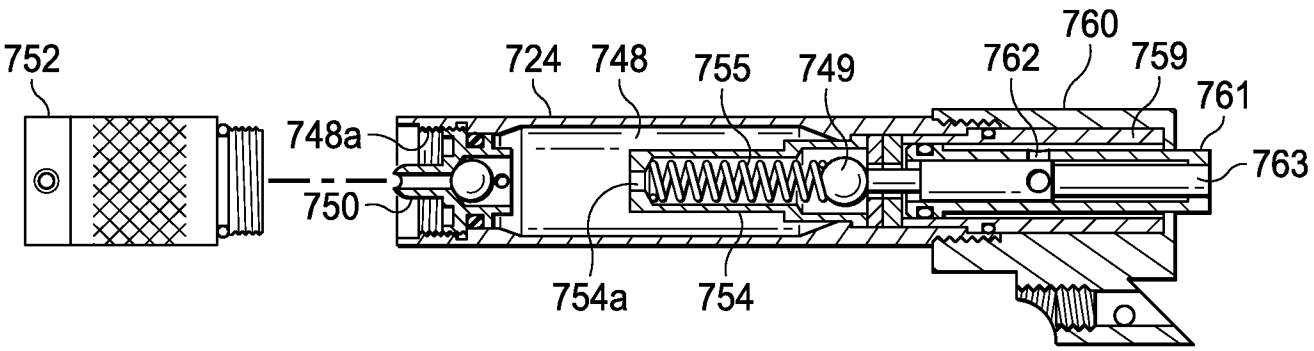

Another barrel unit 724 FIGS. 6*c* and 6*d*, may include a reservoir 748. One end 748*a* of reservoir 748 is threaded and includes a fill port 750. The threaded end 748 can receive a laser unit 752, similar to the laser units described above. A valve housing 754 may be inserted into reservoir 748 for receiving a valve member 749 resiliently urged by a spring member 755. A flexible seal 756 and a rigid washer 757 seat in a chamber 758. A sleeve insert 759 is sealingly seated in a barrel block 760 and a piston 761 seated in insert 759 receives a striker 763. An exhaust port 762 is provided in piston 761. When actuated by a trigger, as described above, striker 763 displaces valve member 749 sufficiently to permit compressed gas from reservoir 748 to pass through a port 754*a* in housing 754 and bypass seal 756 and washer 757 and urge piston 761 and striker 763 aft of sleeve insert 759 until venting occurs from exhaust port 762 in piston 761 thus providing the recoil and audible puff sensations as described above, see also FIG. 6*f*.

Figure 6E:
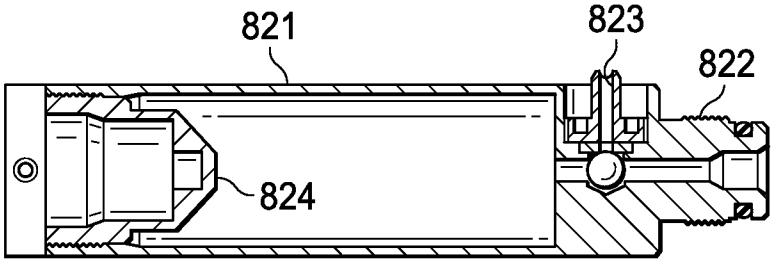
Figure 6F:
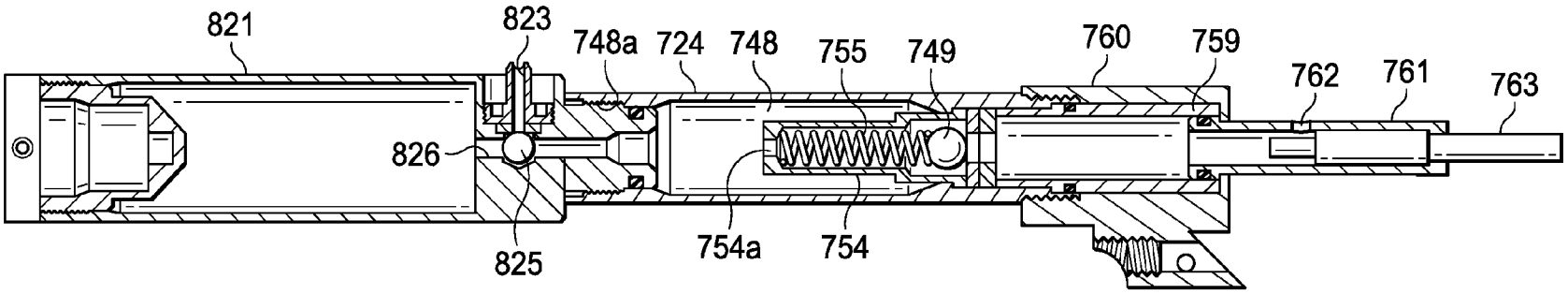

In FIGS. 6*e* and 6*f*, the reservoir 748 is size enhanced by attachment of a supplemental, and larger capacity, auxiliary reservoir 821 including a sealed insert 822 and a side fill port 823 adjacent sealed insert 822. An opposite end of reservoir 821 includes a laser unit 824. Removal of fill port 750 from barrel unit 724, FIG. 6*d*, permits attachment of sealed insert 822 to the end 748*a* of barrel unit 724. Side fill port 823, FIGS. 6*e* and 6*f*, is sealed by a valve 825 when cylinders 821 and 748 are pressurized. A passage 826 interconnects reservoirs 821 and 748 so that pressurized gas in reservoirs 821 and 748 is available for simulated firing. Housing 754 also maintains valve member 749 and spring 755 in a desired position for effective operation.

Referring to the long gun 12, FIG. 2, the simulated barrel unit 34 includes a reservoir 60 for sealingly storing the compressed $CO_2$ gas. One end of the reservoir 60 may include a fill port as discussed above, but is illustrated to include an alternative side fill port 62, to be discussed further below. Also, a laser unit 64 is attached to barrel unit 34 adjacent to the side fill port 62. Due to the alternative side fill port 62, the laser unit 64 may be removably attached via a threaded connection as discussed above, or may be optionally fixedly attached to the simulated barrel unit 34. In addition, the barrel unit 34 and reservoir 60 may be replaced by a size enhanced auxiliary barrel unit 34*a*, FIG. 5, including a barrel reservoir 66*b* and an auxiliary reservoir 66*a* to increase the available number of simulated shots for long gun 12. The reservoir portion 66*a* also includes an alternative side fill port 67, and the laser unit 64 is attached to barrel unit 34*a* adjacent to the side fill port 67. Similar to that described above, the laser unit 64 may be removably attached via a threaded connection or may be optionally fixedly attached.

Figure 7:
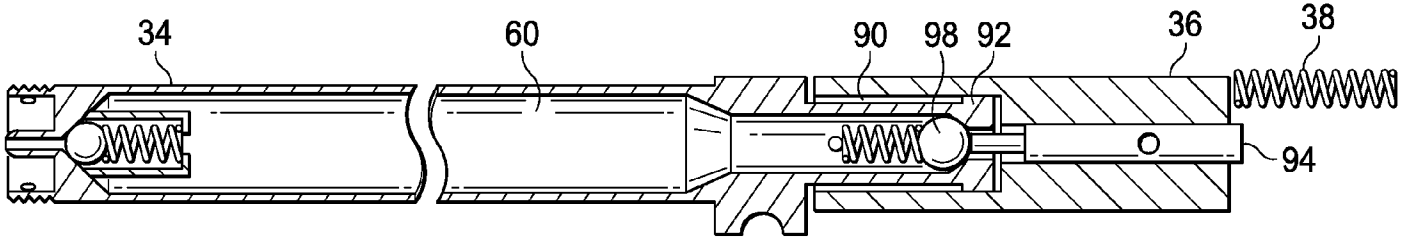

Referring to FIGS. 2 and 7, the simulated firing of long gun 12 is further discussed below. The simulated barrel unit 34 includes bolt 36 having a chamber 90 receiving a piston 92. The bolt 36 includes a striker 94 and the return spring 38 acts to urge bolt 36 to an at rest position as illustrated in FIGS. 2 and 7. Actuation of a trigger 32*a* in trigger portion 32 urges a hammer (not shown) into engagement with striker 94 which unseats a seated metering valve 98 and admits compressed gas from reservoir 60 into chamber 90 thus moving bolt 36 and striker 94 rearward to compress return spring 38. When bolt 36 passes aft of the piston 92 and venting occurs, spring 38 returns bolt 36 and striker 94 to the at rest position.

Figure 8:
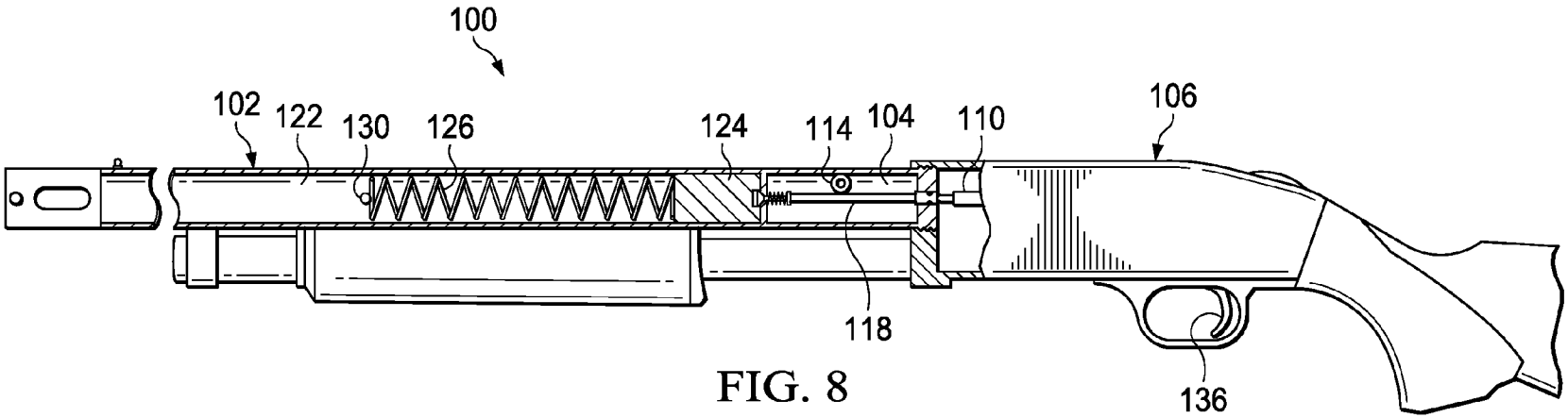
FIGS. 8 and 9 are cut-away sideviews illustrating an embodiment of a long gun having a simulated barrel unit for simulated firing.
Figure 9:
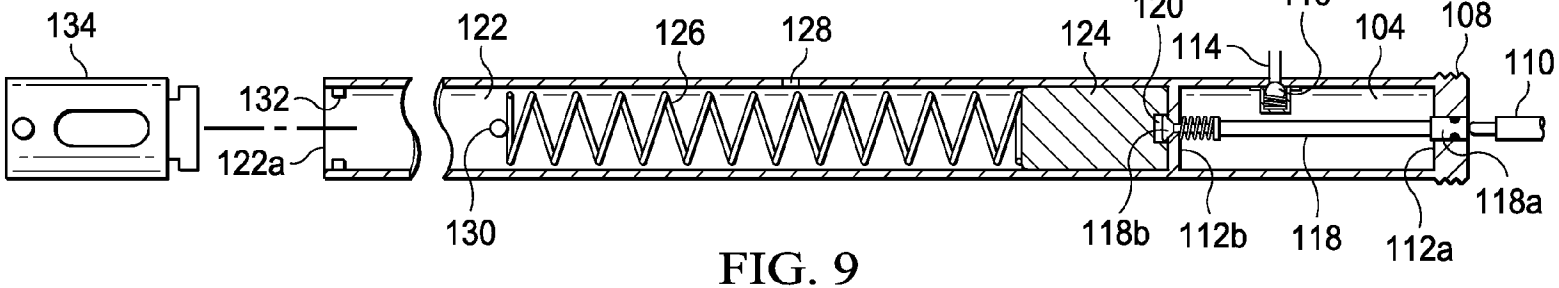

In a further embodiment, FIGS. 8 and 9 illustrate a repeating long gun 100 including a simulated barrel unit 102. The actual barrel unit (not shown) is replaced by the simulated barrel unit 102, which includes a rechargeable compressed gas reservoir 104. The simulated barrel unit 102 may be secured within a repeating shotgun/rifle type of firearm 106 by means of, for example, a threaded end 108, adjacent a firing pin 110, which is part of the firearm 106. Compressed gas reservoir 104 is positioned between a pair of spaced apart walls 112*a*, 112*b*. The reservoir 104 is sealed at the walls 112*a*, 112*b*, as discussed below and is rechargeable via a side fill port 114 including a one-way check valve which may be a ball or other type one-way check valve 116. A striker 118 has one end 118*a* sealed in wall 112*a* adjacent firing pin 110. Another end 118*b* of striker 118 is positioned adjacent wall 112*b* and includes metering check valve 120 at wall 112*b*.

A barrel chamber 122 in barrel unit 102 includes a piston 124, a spring 126, an exhaust port 128, a spring retainer 130 and means 132 for receiving a laser unit 134. The laser unit 134 may be fixedly or removably mounted in an end 122*a* of barrel unit 102.

Simulated firing is accomplished by actuation of a trigger 136 which actuates firing pin 110 into engagement with striker 118 to momentarily unseat valve 120 at wall 112*b*. Compressed air is then admitted into barrel chamber 122 and urges piston 124 to compress spring 126 until piston 124 passes exhaust port 128. Upon exhausting through the port 128, spring 126 urges piston 124 toward wall 112*b*. Rapid movement of piston 124 and its' mass simulates recoil, and venting through port 128 simulates an audible puff.

The foregoing has illustrated several embodiments of actual firearms which can be non-permanently converted to simulated firearms. An advantage to the foregoing is that the compressed air is stored, conducted within and actuates simulated firing members solely with in the simulated barrel unit, thus obviating the need to conduct the compressed gas from remote portions of the firearm to simulate firing. All check valves described herein may be of any suitable sealing type such as ball or other shaped valves, as an example.

Figure 5:
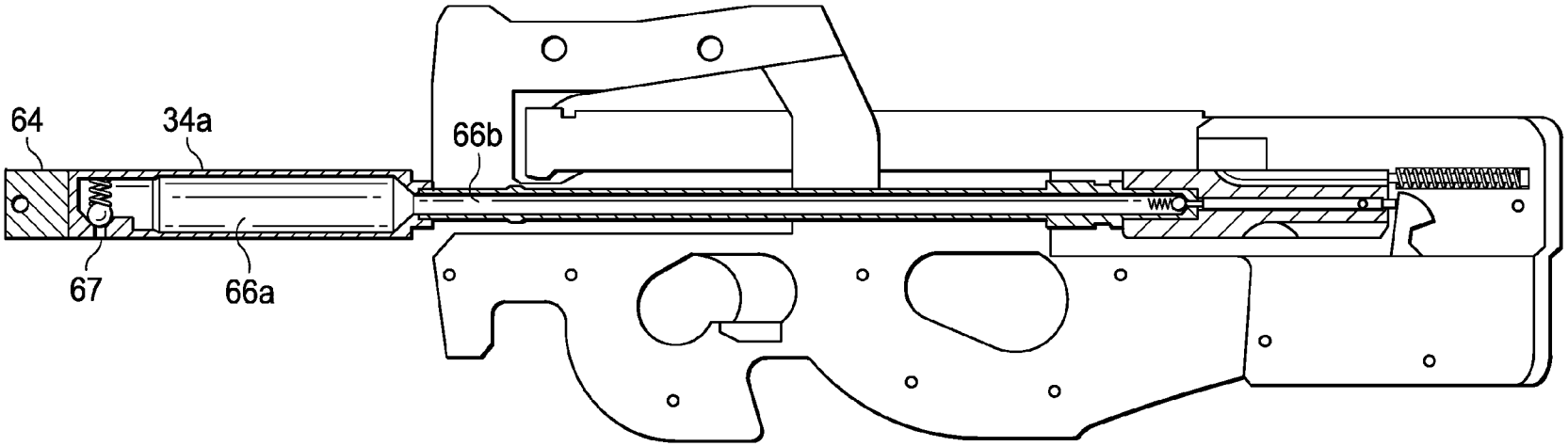
FIG. 5 is a cut-away side view illustrating another embodiment of a long gun configured for simulated firing.
Figure 10:
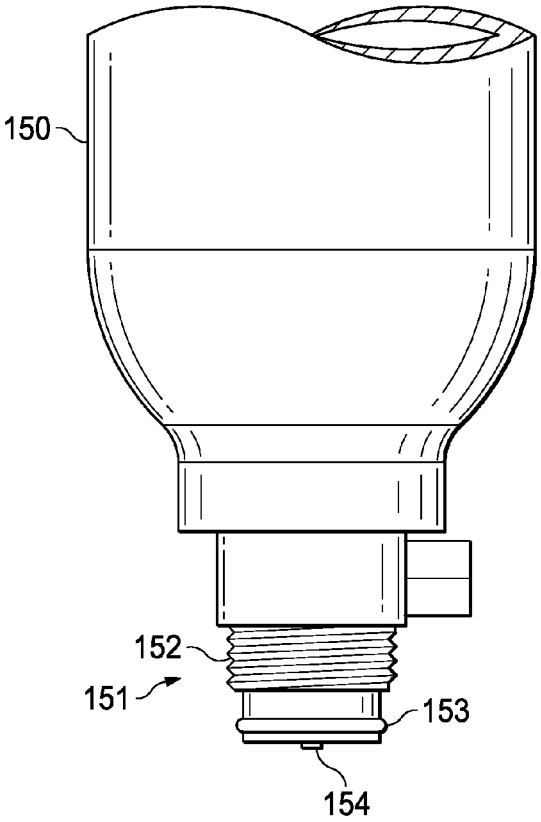
FIG. 10 is a partial side view illustrating an embodiment of a $CO_2$ supply tank used to refill the simulated barrel units.
Figure 12:
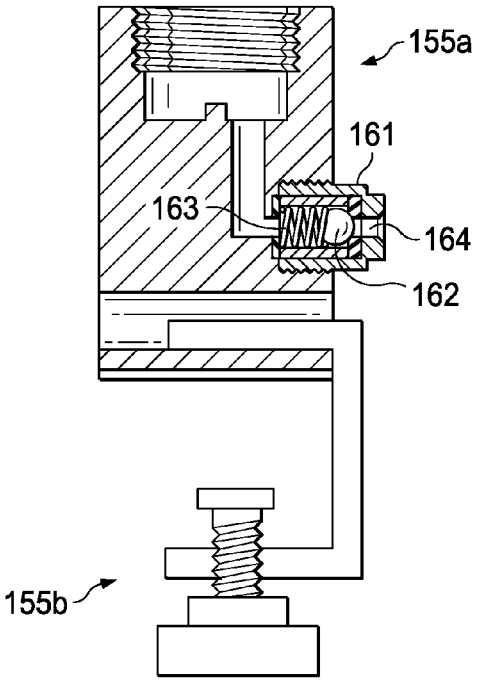
FIG. 12 is another side view cut-away and turned 90° to the view in FIG. 11.
Figure 11:
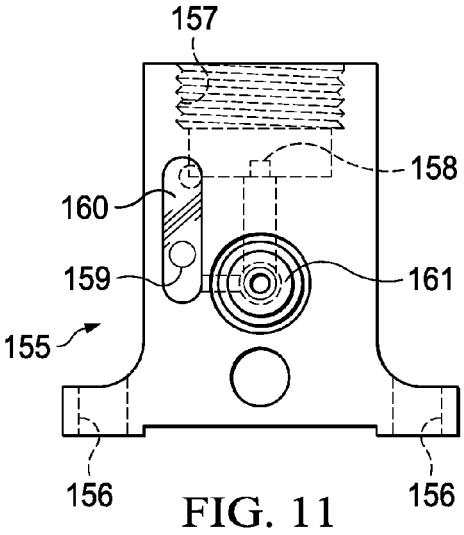
FIG. 11 is a side view illustrating an embodiment of a mount for receiving the supply tank of FIG. 10 and for providing a connection for the refill of the simulated barrels or external reservoirs.
Figure 13:
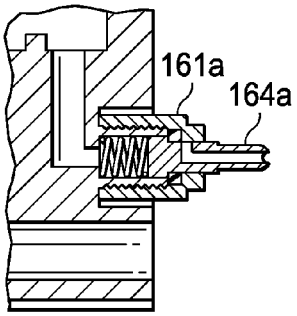
FIG. 13 is a partial cut-away side view for an alternate fill interface.

For refilling the $CO_2$ gas reservoirs in the simulated barrel units described above, a refill station is illustrated in FIGS. 10-13 and is described below. In FIG. 10, a $CO_2$ supply tank 150 is illustrated for providing a $CO_2$ refill to the $CO_2$ cylinders described above and shown in the simulated barrel units. Supply tank 150 includes a refill connection end 151 including a threaded portion 152, a sealing ring 153 and a valve 154. A refill mount 155, FIG. 11 may be secured to a table surface (not shown) by means of an optional suitable fastener extending through apertures 156. The refill connection end 151 of supply tank 150 can be threaded into a threaded aperture 157 in refill mount 155. Upon seating of the supply tank 150 in aperture 157, a probe 158 unseats valve 154 releasing $CO_2$ clear liquid into refill mount 155 and a float 159 visible in an optional window 160 indicates the presence of refill fluid which can be released through the mount 155 at a valve 161. A pressure gauge may be used optionally. In FIG. 12, an alternative mount 155*a* is illustrated and is turned 90° to the view in FIG. 11. In addition, alternative table clamp mount 155*b* is illustrated for securing mount 155*a* in place rather than fasteners discussed above and shown in FIG. 11. Also, the valve 161 mentioned above may be a one-way check valve and may include a ball check valve 162 resiliently urged at 163 to close an outlet 164 of the female type. In FIG. 13, valve 161*a* illustrates a male type outlet 164*a*. For example, the female type outlet 164 of FIG. 12 may be used for a refill interface with nipple 50, FIG. 6, whereas the male type outlet 164*a* may be used for a refill interface with a side fill port 67 as illustrated in FIG. 5.

The firearm conversions illustrated and described herein are exemplary, however such conversions can be accomplished with modification where necessary, in any type of firearm where appropriate for converting an actual firearm, whether used for sport or as a weapon, to a firearm used for simulated shooting.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

The invention claimed is:

1. An apparatus for non-permanent conversion of a firearm into a compressed gas powered firearm simulator for simulated shooting comprising:

the firearm including a combination of actual firearm components and simulated firearm components including a simulated barrel unit;

the simulated barrel unit including a limited capacity, self-contained and sealingly stored compressed gas reservoir, a fill port for recharging the compressed gas reservoir and a metering valve actuated by a firing mechanism in the firearm for releasing compressed gas from the reservoir to simulate firing of the firearm; and the barrel unit including a muzzle end supporting the fill port and a laser emitter.

2. The apparatus of claim 1 wherein the simulated barrel unit includes a chamber, a piston, a slide and a striker mounted in the piston and wherein a firing sequence causes movement of the striker, the striker being moved sufficiently to unseat the metering valve, whereby compressed gas is admitted from the reservoir into the chamber, causing displacement of the piston, the slide and the striker from an at rest position, thus simulating recoil, and sequentially enabling the chamber to be vented, whereby a recoil spring returns the slide, the piston and the striker to the at rest position.

3. The apparatus of claim 1 wherein the simulated barrel unit includes a piston, a bolt, a chamber, a striker, and a recoil spring, and wherein a firing sequence causes movement of the striker, the striker being moved sufficiently to unseat the metering valve, whereby compressed gas is admitted from the reservoir into the chamber, causing displacement of the bolt from an at rest position, thus simulating recoil, sequentially enabling the chamber to be vented and whereby the recoil spring returns the bolt and the striker to the at rest position.

4. The apparatus of claim 1 wherein the simulated barrel unit includes a barrel chamber, a piston and a recoil spring in the barrel chamber, and a striker, and wherein a firing sequence causes movement of the striker, the striker being moved sufficiently to unseat the metering valve, whereby compressed gas is admitted from the reservoir into the barrel chamber, causing displacement of the piston from an at rest position, thus simulating recoil, sequentially enabling the barrel chamber to be vented and whereby the recoil spring returns the piston to the at rest position.

5. The apparatus of claim 1, further comprising:

the simulated barrel unit including a tubular barrel member having a removable threaded connection with an adjacent barrel block.

6. The apparatus of claim 1, further comprising;

an auxiliary rechargeable compressed gas reservoir attached to the muzzle end of the simulated barrel unit and a laser emitter being attached to the auxiliary compressed gas reservoir.

7. The apparatus of claim 1, further comprising:

the simulated barrel unit including a barrel chamber, a piston in the barrel chamber having an exhaust port, and a striker movably mounted in the piston, and wherein a firing sequence causes movement of the striker sufficiently to unseat the metering valve whereby compressed gas is admitted from the reservoir into the barrel chamber, causing displacement of the piston and striker within the chamber until venting occurs via the exhaust port.

8. The apparatus of claim 1 including a barrel block having an adjustment screw and a pin provided for tolerance adjustment.

9. The apparatus of claim 1 wherein the fill port for recharging is mounted in a sidewall of the simulated barrel unit.

10. The apparatus of claim 1 wherein the firearm is a handgun.

11. The apparatus of claim 10 wherein the handgun includes frame, a grip portion and a trigger portion being actual firearm components.

12. The apparatus of claim 1 wherein the firearm is a long gun.

13. The apparatus of claim 12 wherein the apparatus further includes a simulated bolt and a return spring.

14. The apparatus of claim 1 wherein the firearm includes a simulated magazine unit housing a shot counter and an actuator to interrupt simulated firing in response to a predetermined number of simulated shots being fired.

15. The apparatus of claim 1 wherein the self-contained, sealingly stored compressed gas reservoir is refilled through the fill port by a refill tank including a threaded end attached to a threaded refill mount having a refill outlet releasing compressed gas through the refill outlet which is sealingly engaged with the fill port.

16. Apparatus for non-permanent conversion of a firearm into a compressed gas powered firearm simulator for simulated shooting comprising:

the firearm including a combination of actual firearm components and simulated firearm components including a simulated barrel unit:

the simulated barrel unit including a limited capacity, self-contained and sealingly stored compressed gas reservoir, a muzzle end of the barrel unit having an internal threaded portion;

a fill port mounted in the threaded portion and being operable for permitting recharging the compressed gas reservoir;

a piston adjacent the compressed gas reservoir; and a striker movably mounted in the piston.

17. The apparatus of claim 16, further comprising:

a laser emitter attached to the internal threaded portion of the muzzle end of the simulated barrel unit adjacent the fill port.

18. The apparatus of claim 16, further comprising:

an auxiliary rechargeable compressed gas reservoir attached to one end of the simulated barrel unit, a laser emitter being attached to the auxiliary compressed gas reservoir.

19. The apparatus of claim 16, further comprising:

the piston including an exhaust port and being movably mounted in a sleeve; and a metering valve operable for displacement in response to an impact by the striker for releasing compressed gas from the reservoir and into the piston, urging the piston and striker from the sleeve until venting occurs via the exhaust port.

20. System for non-permanent conversion of a firearm into a compressed gas powered firearm simulator for simulated shooting comprising:

the firearm including a combination of actual firearm components and simulated firearm components including a simulated barrel unit:

the simulated barrel unit including a first limited capacity, self-contained and sealingly stored compressed gas reservoir;

a valve housing mounted in and being in fluid communication with the compressed gas reservoir;

a piston adjacent the compressed gas reservoir;

a movably mounted striker;

a second limited capacity, self-contained and sealingly stored compressed gas reservoir attached to the first compressed gas reservoir;

a conduit fluidly connecting the first and second rechargeable compressed gas reservoirs;

a fill port operable for recharging the first and second rechargeable compressed gas reservoirs, the fill port being in fluid communication with the conduit; and a metering valve mounted in the valve housing, the metering valve being operable for displacement in response to an impact by the striker for releasing compressed gas from the first and second compressed gas reservoirs, through the valve housing and into the piston.

21. The system of claim 20, further comprising:

a laser unit attached to the second rechargeable compressed gas reservoir.

22. The system of claim 20 wherein the fill port includes a port extending from a sidewall of the second rechargeable compressed gas reservoir.

23. The system of claim 20, further including:

a sleeve insert housing the piston and the striker.

* * * * *